United States Patent [19]

Okamoto

[11] 4,041,700

[45] Aug. 16, 1977

[54] MANIFOLD REACTOR

[75] Inventor: Takamitsu Okamoto, Toyota, Japan

[73] Assignee: Toyota Jidosha Kogyo Kabushiki Kaisha, Toyota, Japan

[21] Appl. No.: 683,221

[22] Filed: May 4, 1976

[30] Foreign Application Priority Data

Feb. 17, 1976 Japan ..... 51-17702

[51] Int. Cl.[2] ..... F02M 25/06; F01N 3/10

[52] U.S. Cl. ..... 60/278

[58] Field of Search ..... 60/278, 282

[56] References Cited

U.S. PATENT DOCUMENTS

| | | | |
|---|---|---|---|
| 3,237,615 | 3/1966 | Daigh | 60/278 |
| 3,722,221 | 3/1973 | Chopin | 60/282 |
| 3,948,044 | 4/1976 | Wakita | 60/278 |

*Primary Examiner*—Douglas Hart

*Attorney, Agent, or Firm*—Birch, Stewart, Kolasch and Birch

[57] ABSTRACT

A manifold reactor of a dual-walled structure including inner and outer cores, the inner core defining a reactor chamber therein, wherein the space defined between the inner and outer cores is opened to the reactor chamber so as to be filled with exhaust gases which, after having filled the heat insulating space, is drawn therefrom as EGR gas.

4 Claims, 1 Drawing Figure

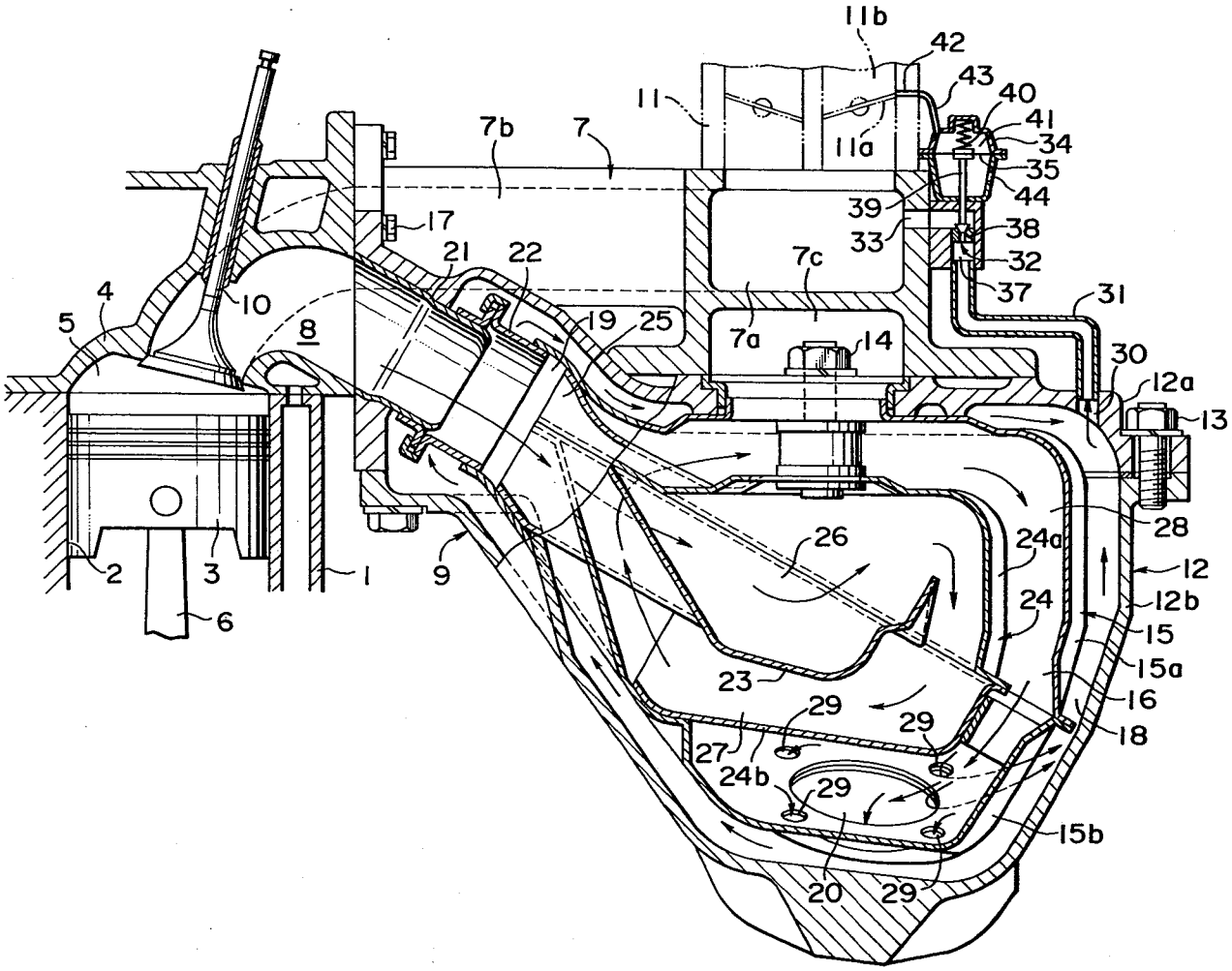
13
12a
12
12b
28
15
15a
16
18
15b
30
31
24a
24
29
20
24b
27
23
26
14
7c
7a
39
33
11a
11b
42
43
40
41
34
35
44
38
32
37
11
7
7b
25
19
22
21
17
9
1
8
10
3
6
2
4
5

MANIFOLD REACTOR

BACKGROUND OF THE INVENTION

1. Field of the Invention

The present invention relates to a manifold reactor to be mounted in an internal combustion engine for purifying exhaust gases and, more particularly, a structure for a multi-walled manifold reactor including outer and inner cores.

2. Description of the Prior Art

The manifold reactor is a device which is mounted in an internal combustion engine closely adjacent the exhaust ports thereof as a substitute for an ordinary exhaust manifold for the purpose of purifying exhaust gases from the engine by utilizing the heat owned by the exhaust gases themselves so as to recombust harmful uncombusted components such as HC and CO contained in the exhaust gases by high temperature oxidization effected in a reactor chamber defined therein. Conventionally, the manifold reactor has generally a double or triple walled structure composed of outer and inner cores or the like in order to obtain better heat insulation for the reactor chamber, wherein the spaces defined between the outer and inner cores is filled with a layer of a solid heat insulating material so that a more improved heat insulation of the reactor chamber is obtained. However, in spite of these complicated multilayered structures for the manifold reactor, when the engine starts from a low temperature condition with the inner core which defines the reactor chamber being also in a low temperature condition, sufficient oxidizing reaction is not effected in the reactor chamber. This problem becomes more serious in a counter flow type engine wherein a riser portion of the intake manifold is heated by the exhaust gases existing in the reactor chamber because, in this case, the temperature of the exhaust gases further lowers due to a loss of heat caused by heating the riser portion. Thus, there is a problem that even if a relatively massive heat insulation has been applied to the reactor chamber, sufficient oxidizing reaction does not take place in the reactor chamber.

SUMMARY OF THE INVENTION

Therefore, it is the object of the present invention to solve the abovementioned problem and to provide an improved manifold reactor which provides better heat insulation for the reactor chamber so that sufficient oxidizing reaction can take place therein.

According to the present invention, the abovementioned object is accomplished by a manifold reactor comprising an inner core which defines a reactor chamber therein, said inner core having inlet and outlet ports for conducting exhaust gases into and out of said reactor chamber and an outer core which encloses said inner core while defining a heat insulating space between said inner and outer cores, said heat insulating space being connected with said reactor chamber through an opening formed in said inner core and communicating to an EGR gas intake port formed in said outer core.

In the manifold reactor of the abovementioned structure, a portion of the exhaust gases in the reactor chamber flows into the heat insulating space through said opening to fill the space with the relatively hot exhaust gases thereby rapidly heating the inner core after the startup of the engine and maintaining same in a hot condition during warming-up operation of the engine. The exhaust gases which have filled the heat insulating space and have given up some of their heat for maintaining the reactor cores in a hot condition are exhausted therefrom through said EGR gas intake port to be effectively used as EGR gas which should not be very hot in view of maintaining a high intake efficiency. By this arrangement, i.e., the exhaust gases which have first been utilized for heating the reactor cores are subsequently utilized as the EGR gas, any stagnation of heating gas is avoided and good warming up of the reactor cores as well as maintenance of the warmed-up condition are available.

The performance of warming up the reactor cores, particularly the inner core is much better in the manifold reactor of the present invention when compared with the conventional manifold reactors having a heat insulating layer made of a solid heat insulating material provided for the inner core. This difference in the warming-up performance is more remarkable in an initial stage during the warming up of the engine. Furthermore, since the EGR gas is supplied from the cooler gas source forming the heat insulating gas layer for the reactor cores, an optimum design for the temperature of EGR gas is made possible in connection with an optimum design of the manifold reactor in the light of purifying the exhaust gases.

The manifold reactor according to the present invention is realized by applying a small change in design to existing manifold reactors because, in this case, it is only necessary to eliminate the conventional heat insulating layer made of a solid heat insulating material from the space defined between the inner and outer cores. Therefore, it will be appreciated that the manifold reactor according to the present invention is more economical than the conventional ones and provides an additional advantage in the fact that any chips or flocks of the heat insulating material do not enter into the exhaust system, such chips or flocks causing the risk of damage to a catalytic converter if they enter into the exhaust system.

Said opening which connects said heat insulating space with the inside of the reactor chamber should preferably be provided adjacent the exhaust port from the reactor chamber because, by this arrangement, hot gases which have completed oxidization in the reactor chamber are available for the purpose of heating and heat insulting the reactor core structure. The inner core itself should preferably be designed to make the exhaust gases stay for a sufficient time to accomplish required oxidizing reaction by, for example, circulating the exhaust gases therein due to a multi-walled structure incorporated therein according to any conventional fashion.

BRIEF DESCRIPTION OF THE DRAWING

The accompanying drawing is a sectional view of an embodiment of the manifold reactor of the present invention together with some associated portions of an internal combustion engine.

DESCRIPTION OF THE PREFERRED EMBODIMENT

Turning now to the drawing, reference 1 designates a cylinder block defining a cylinder 2 in which is mounted a piston 3 to reciprocate up and down. The upper end of the cylinder 2 is closed by a cylinder head 4 which cooperates with the cylinder block 1 to define a combustion chamber 5 located above the piston 3. The piston is connected with a crank shaft (not shown) by a piston rod 6 only partly shown in the FIGURE so as to convert the reciprocating power of the piston to the rotational power of the crank shaft. On one side of the cylinder head 4 is mounted an intake manifold connected with intake ports (now shown) formed in the cylinder head as well as a manifold reactor 9 connected with exhaust ports 8 (only one is shown), said intake manifold and said manifold reactor being closely arranged with one over the other. The exhaust port 8 is opened toward or shut off from the combustion chamber 5 by an exhaust valve 10 provided in the cylinder head 4.

The intake manifold 7 is supplied with fuel-air mixture from a carburetor 11 of a conventional structure which is partly shown by phantom lines, said fuel-air mixture flowing through a riser portion 7*a* and branch passages 7*b* until it is finally introduced into the combustion chamber 5 to be combusted therein. The exhaust gases generated from combustion of the fuel-air mixture are discharged through the exhaust ports 8 in accordance with opening or shutting-off of the exhaust valves 10 into the manifold reactor 9 and after having being purified so that CO and HC contained therein are recombusted under a high temperature, the purified exhaust gases are exhausted from the manifold reactor through an outlet port (not shown) toward the atmosphere.

The manifold reactor 9 comprises an outer core 12 composed of an upper member 12*a* and a lower member 12*b* joined together at flange portions thereof by bolt-nut means 13 and an inner core 15 positioned within said outer core as suspended therefrom by suspension bolt-nut means 14, said inner core defining a reactor chamber 16 therein. The manifold reactor 9 is supported from the cylinder head 4 by one end portion of the reactor being mounted to the cylinder head by means of bolts 17. The inner core 15 is composed of an upper member 15*a* and a lower member 15*b* joined together at flange portions thereof by welding or other suitable connecting means. Between the outer core 12 and the inner core 15 is defined a heat insulating space 18. The inner core 15 has an inlet port 19 for introducing exhaust gases therein at a portion located closer to the cylinder head 4 and an outlet port 20 for discharging exhaust gases therefrom at a portion located remote from said inlet port. The outlet port 20 is connected with an end of an exhaust pipe (not shown) in the FIGURE. In this case, said end portion of the exhaust pipe is gas-tightly connected with the outer core 12 while it is loosely engaged with the inner core so that a relative movement between the inner and outer cores due to thermal expansion thereof is permitted. The exhaust gas inlet port 19 is connected with the exhaust port 8 by way of a port tube 21 and a connecting tube 22.

At the inside of the inner core 15 or within the reactor chamber 16 are mounted an internal deflecting means 23 and an intermediate deflecting means 24, the latter being composed of an upper member 24*a* and a lower member 24*b* connected together at flange portions thereof by welding or other suitable connecting means and suspended from the outer core by said bolt-nut means 14. The exhaust gases introduced into the reactor chamber through said exhaust gas inlet port 19 flow through a passage defined by said internal deflecting member 23 and said upper member 24*a* as schemmatically shown by arrows and enter into a first chamber 26 defined by said two members. From said first chamber, the gases flow into a second chamber 27 defined by said internal deflecting member 23 and the lower member 24*a* and further flow through a third chamber 28 defined between the intermediate deflecting means 24 and inner core 15 until they reach the exhaust gas outlet port 20 from which they are exhausted through said exhaust pipe (not shown) in the FIGURE. In this manner, the exhaust gases introduced into the reactor chamber 16 are circulated through various regions in the chamber by being guided by said deflecting means so that the exhaust gases stay in the reactor chamber for a sufficiently long enough time to accomplish the high temperature oxidization before they are discharged through said outlet port 20. During this circulation a portion of the high temperature exhaust gases is diverted from said third chamber 28 toward a heating chamber 7*c* defined below the riser portion 7*a* of the intake manifold 7 so as to heat the bottom wall of the riser portion.

Adjacent the outlet port 20 a plurality of openings 29 are formed in the inner core 15 for connecting the reactor chamber 16 and the heat insulating space 18. The outer core 12 is formed with an EGR gas intake port 30 opening at an upper portion of the upper member 12*a* which is remote from said openings 29. The EGR gas intake port 30 is connected with an EGR gas supply port 33 formed in the riser portion 7*a* of the intake manifold 7 by way of a conduit 31 and an EGR valve 32. In the shown embodiment, the EGR valve 32 is a diaphragm valve of a well-known type including a diaphragm casing 34, a diaphragm 35 mounted in said diaphragm casing, a valve element 39 carried by said diaphragm 35 and adapted to cooperate with a valve seat 38 provided in the midst of a valve passage 37 connecting the EGR gas supply port 33 and the conduit 31 so as to control the opening of the valve passage 37 and a compression coil spring 40 which urges the diaphragm 35 and the valve element 39 toward the valve seat. Above the diaphragm 35 is defined an actuating chamber 41 which is connected with a port 42 through a conduit 43, said port 42 opening to a fuel-air mixture passage 11*b* at a portion located just upstream of a throttle valve 11*a* when the throttle valve is in its full closed position. The space defined below the diaphragm 35 is opened to the atmosphere through a port 44. The EGR valve 32 having the abovementioned structure operates to open in accordance with the vacuum applied to the port 42 so that an amount of EGR gas proportional to the amount of intake air is supplied to the EGR gas supply port.

A portion of the exhaust gases which have already finished recombustion and reached around the outlet port 20 passes through the openings 29 and a clearance defined between the outlet port 20 and the associated end portion of the exhaust pipe (not shown) and enters into the heat insulating space 18 thereby filling this space with hot exhaust gases, thus effecting heating up as well as heat insulation of the inner core. The exhaust gases entered into the heat insulating space 18 are gradually withdrawn from the space through the EGR gas intake port 30 and conducted through the conduit 31 and the EGR valve 32 so as to be supplied from the port 33 to the riser portion 7*a* of the intake manifold 7 as the EGR gas in proportion to the amount of intake air under the control of EGR valve 32.

Although the invention has been shown and described with respect to a preferred embodiment thereof, it should be understood by those skilled in the art that various changes and omissions in the form and detail thereof may be made therein without departing from the spirit and scope of the invention.

I claim:

1. A manifold reactor comprising an inner core which defines a reactor chamber therein, said inner core having inlet and outlet ports for conducting exhaust gases into and out of said reactor chamber, and an outer core which encloses said inner core while defining a heat insulating space between said inner core while defining a heat insulating space between said inner and outer cores, said heat insulating space being connected with said reactor chamber through an opening formed in said inner core and communicating to an EGR gas intake port formed in said outer core.

2. The manifold reactor of claim 1, wherein said opening is located adjacent said outlet port.

3. The manifold reactor of claim 1, wherein said EGR gas intake port is located as far from said opening as possible.

4. The manifold reactor of claim 1, wherein said reactor chamber is divided into a plurality of chamber portions through which exhaust gases successively flow so that the gases stay for a sufficient time to finish high temperature oxidization therein.

* * * * *